US007812795B2

(12) United States Patent
Chen et al.

(10) Patent No.: US 7,812,795 B2
(45) Date of Patent: Oct. 12, 2010

(54) MODULATION OF COMMON VOLTAGE AND METHOD FOR CONTROLLING AMOLED PANEL

(75) Inventors: Chi-Wen Chen, Hsinchu (TW); Meng-Hsiang Chang, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 826 days.

(21) Appl. No.: 11/683,443

(22) Filed: Mar. 8, 2007

(65) Prior Publication Data

US 2008/0088544 A1 Apr. 17, 2008

(30) Foreign Application Priority Data

Oct. 16, 2006 (TW) ..... 95138018 A

(51) Int. Cl.
*G09G 3/30* (2006.01)

(52) U.S. Cl. ..... 345/76; 345/102; 345/204; 345/211; 315/100

(58) Field of Classification Search ..... 345/76, 345/211, 204, 102; 315/100
See application file for complete search history.

(56) References Cited

U.S. PATENT DOCUMENTS 5,798,741 A * 8/1998 Kajihara ..... 345/94
6,335,713 B1 1/2002 Imai
6,353,291 B1 * 3/2002 Borgogno et al. ..... 315/169.3
6,456,016 B1 9/2002 Sundahl et al.
2004/0046757 A1 * 3/2004 Yamada ..... 345/211
2004/0174349 A1 * 9/2004 Libsch et al. ..... 345/204
2004/0178740 A1 * 9/2004 Chang et al. ..... 315/100
2004/0235224 A1 * 11/2004 Lin et al. ..... 438/149
2005/0007321 A1 * 1/2005 Schuler ..... 345/82
2005/0116921 A1 * 6/2005 Kim ..... 345/102
2006/0145967 A1 * 7/2006 Huh ..... 345/76

FOREIGN PATENT DOCUMENTS

CN 1435811 8/2003
JP 06175622 A * 6/1994

OTHER PUBLICATIONS

BIB data sheet of CN1435811.*

* cited by examiner

*Primary Examiner*—Amare Mengistu
*Assistant Examiner*—Premal Patel
(74) *Attorney, Agent, or Firm*—Jianq Chyun IP Office

(57) ABSTRACT

A control circuit for use in an active matrix organic light emitting diode (AMOLED) panel comprising a memory unit and a voltage control unit is provided. The operating time of the AMOLED panel is counted and saved by the memory unit. According to the memory unit's information, the voltage control unit decides a common voltage. The purpose of the present invention is to reduce the common voltage when the turn-on time of the AMOLED panel is increased so that the increase in the voltage difference between the two terminals of an organic light emitting diode (OLED) of the AMOLED panel may be compensated. Thus, the present invention may provide a stable driving current for the OLED and a stable picture definition for the AMOLED panel.

12 Claims, 3 Drawing Sheets

MODULATION OF COMMON VOLTAGE AND METHOD FOR CONTROLLING AMOLED PANEL

CROSS-REFERENCE TO RELATED APPLICATION

This application claims the priority benefit of Taiwan application serial no. 95138018, filed Oct. 16, 2006. All disclosure of the Taiwan application is incorporated herein by reference.

BACKGROUND OF THE INVENTION

1. Field of the Invention

The present invention relates to an active matrix organic light emitting diode (AMOLED) panel, and more particularly, to an AMOLED panel with an adjustable common voltage.

2. Description of Related Art

The current generation is frequently proclaimed as the 3C era: the Computer, the Communication and the Consumer electronics era. In our daily life, we encounter all kinds of information products such as mobile phones, personal digital assistants (PDAs), global positioning satellite (GPS) systems, digital cameras and displays. However, most information equipment uses a flat panel display as the main communication medium.

With the proliferation of information equipment, a variety of flat panel displays, for example, liquid crystal display, plasma display and organic light emitting diode (OLED) panel, are available for selection. The OLED panel not only has the advantages of a higher brightness level, lower power consumption, higher contrast, rapid response and lower driving voltage, but also has the capability to be miniaturized according to the current trend of communication equipment. Therefore, a large number of OLED panel products are developed in recent years.

According to the driving method of the organic light emitting diode (OLED), OLED panels can be classified into passive matrix organic light emitting diode (PMOLED) panels and active matrix organic light emitting diode (AMOLED) panels. Since AMOLED panels can be applied to a large size panel, it has more development potential. In general, the pixel unit of an AMOLED panel at least comprises a transistor and an organic light emitting diode. The transistor has a first terminal connected to a operating voltage and a second terminal connected to the anode of the organic light emitting diode. The cathode of the organic light emitting diode is coupled to a common voltage. In addition, after the AMOLED panel is being operated for a period of time, the voltage difference across the terminals of the organic light emitting diode (OLED) of the AMOLED panel will increase along with the operating time. However, the voltage difference between the first and second terminals of the transistor together with the voltage difference across the terminals of the OLED are a constant value equivalent to the voltage difference between the operating voltage and the common voltage. Hence, if the voltage difference across the OLED is allowed to continuously increase, the voltage difference between the first and second terminal of the transistor will decrease continuously. When the voltage difference changes too much, the transistor can no longer provide a stable driving current to drive the OLED. Ultimately, the picture quality of the AMOLED panel is also adversely affected.

SUMMARY OF THE INVENTION

Accordingly, the present invention is to provide a flat panel display and an active matrix organic light emitting diode (AMOLED) panel such that the driving current of the AMOLED panel can be adjusted according to the operating time of the AMOLED panel.

In addition, the present invention is to provide a method of controlling an AMOLED panel such that the common voltage is adjusted according to the operating time of the AMOLED panel.

To achieve these and other advantages and in accordance with the purpose of the invention, as embodied and broadly described herein, the invention provides a control circuit for an AMOLED panel with a common voltage. The control circuit of the AMOLED panel includes a memory unit and a voltage control unit. The memory unit counts and saves the operating time when the AMOLED panel is turned on, and the voltage control unit adjusts the common voltage according to the operating time of the AMOLED panel.

The present invention also provides a flat panel display comprising an AMOLED panel, a timing controller, a power supply and a control circuit. The AMOLED panel has a plurality of pixel units. The timing controller drives the AMOLED panel and the power supply provides an operating voltage and a common voltage to the AMOLED panel. In addition, the control circuit is electrically coupled to the timing controller for detecting the operating time of the AMOLED panel. According to the operating time of the AMOLED panel, the control circuit in the present invention controls the power supply to adjust the common voltage under the condition of a constant operating voltage.

In addition, the present invention provides a method for controlling an AMOLED panel. First, an operating voltage and a common voltage are produced for the AMOLED panel. Then, the using time of the AMOLED panel is detected. Finally, according to the operating time of the AMOLED panel, the common voltage is adjusted under the condition of a constant operating voltage.

Furthermore, the memory unit can be used to count the turn-on frequency of the AMOLED panel and save the value. The common voltage can be adjusted through the voltage control unit according to the turn-on frequency of the AMOLED panel.

Because the control circuit provided by the present invention is capable of detecting either the operating time of the AMOLED panel or counting the turn-on frequency of the AMOLED panel and using either the using time or turn-on frequency to control the power supply and adjust the common voltage under the condition of a fixed operating voltage, the present invention can provide a stable driving current for the organic light emitting diode and an AMOLED panel with a more stable picture quality.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
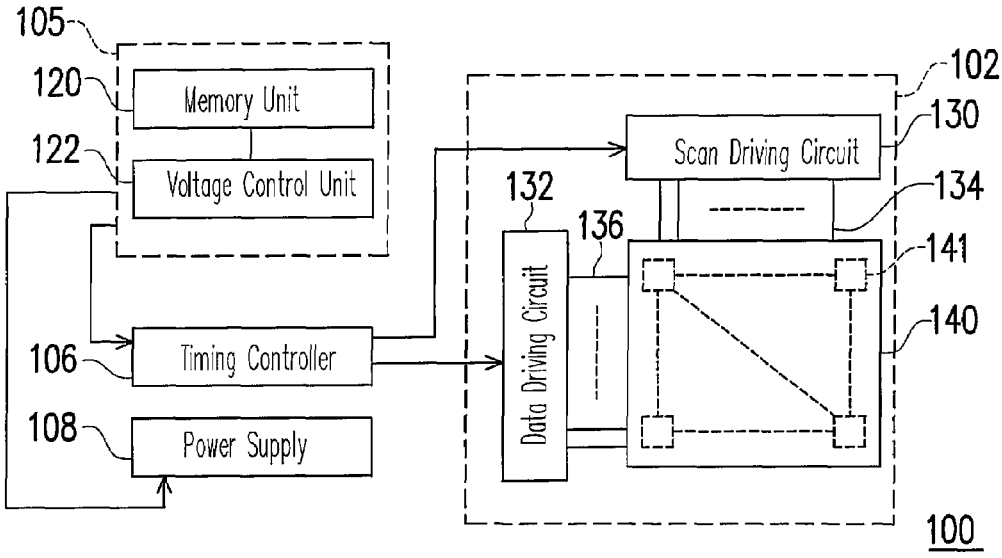
FIG. 1 is a circuit diagram of an active organic light emitting display according to a preferred embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a circuit diagram of an active organic light emitting display according to a preferred embodiment of the present invention. As shown in FIG. 1, the present invention provides a flat panel display 100 including an active matrix organic light emitting diode (AMOLED) panel 102, a control circuit 105, a timing controller 106 and a power supply 108. The power supply 108 provides the power for operating the AMOLED panel 102 and the control circuit 105 controls the power supply 108 for adjusting the power to the AMOLED panel 102 according to the operating condition of the AMOLED panel 102.

The AMOLED panel 102 includes a scan driving circuit 130, a data driving circuit 132 and a pixel array 140. The scan driving circuit 130 is electrically coupled to the pixel array 140 through a plurality of scan lines, and the data driving circuit 132 is electrically coupled to the pixel array 140 through a plurality of data lines 136.

The pixel array 140 has a plurality of pixels 140 arranged to form an array, and each pixel 141 is disposed at the junction between each scan line and data line. Thus, the scan driving circuit 130 may generate a scan signal to the pixel array 140 according to the output from the timing controller 106 so that the pixels on each scan line are enabled sequentially. Meanwhile, the data driving circuit 132 generates a data voltage signal to the pixel array 140 according to the output from the timing controller 106 to turn on the enabled pixels 141.

In general, the power supply 108 provides an operating voltage and a common voltage to each pixel 141 (a more detailed description is provided below) of the pixel array 140. The control circuit 105 may control the power supply 108 to adjust the common voltage provided to the pixel 141 according to the on or off state of each pixel 141.

The control circuit 105 includes a memory unit 120 and a voltage control unit 122. The memory unit 120 can be used to count and save the operating time of the pixel 141 in the AMOLED panel 102. Thus, the voltage control unit 122 is able to control the power supply 108 according to the information stored in the memory unit 120 such that the common voltage to the pixel array 140 can be adjusted according to the operating time of the AMOLED panel 102.

Figure 2:
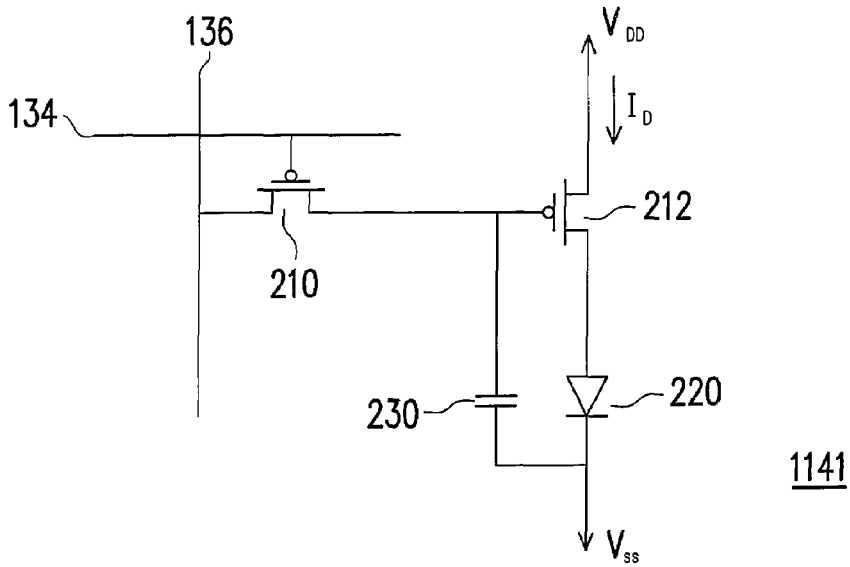
FIG. 2 is a circuit diagram of a pixel unit according to a preferred embodiment of the present invention.

FIG. 2 is a circuit diagram of a pixel unit 1141 according to a preferred embodiment of the present invention. The pixel units 141 in FIG. 1 can be implemented using the pixel units 1141. As shown in FIG. 2, the pixel unit 1141 includes transistors 210, 212, an organic light emitting diode 220 and a storage capacitor 230. In the present embodiment, the transistors 210 and 212 can be implemented using PMOS transistors. The transistor 212 has a controlling terminal used for receiving a data voltage, a first terminal coupled to an operating voltage $V_{DD}$ and a second terminal coupled to the anode of the organic light emitting diode 220. The cathode of the organic light emitting diode 220 is coupled to a common voltage $V_{SS}$ of the AMOLED panel 210. Furthermore, the transistor 210 has a controlling terminal coupled to a scan line 134, a first terminal coupled to a data line 136 and a second terminal electrically coupled to the controlling terminal of the transistor 212.

As shown in FIGS. 1 and 2, when the pixel unit 1141 is driven, the timing controller 106 generates a control signal to the scan driving circuit 130 so that the scan driving circuit 130 generates a scan signal and activates the transistor 210 to conduct through the scan line 134. Meanwhile, the timing controller 106 also generates a control signal so that the data driving circuit 132 generates and transmits a data voltage signal to the pixel unit 1141 through the data line 136 and then transmitted to the controlling terminal of the transistor 212 through the transistor 210. Thus, the transistor 212 is turned on and a driving current $I_D$ is generated to drive the organic light emitting diode 220.

It can be clearly seen from FIG. 2 that the voltage difference between the operating voltage VDD and the common voltage VSS is fixed. This voltage difference is equivalent to the voltage difference between the first terminal and the second terminal of the transistor 212 and the voltage difference across the organic light emitting diode 220. Because the voltage across the terminals of the organic light emitting diode 220 will increase with the total operating time, the voltage difference between the first and second terminal of the transistor 212 reduces continuously. However, when the AMOLED panel 102 is in operation, the transistor 212 operates in the saturated region with the condition $V_{DS} \geqq V_{GS} - V_T$. Here, $V_{DS}$ represents the voltage difference between the first terminal and the second terminal of the transistor 212, $V_{GS}$ represents the voltage difference between the controlling terminal and the first terminal of the transistor 212, and $V_T$ represents the threshold voltage. If the voltage $V_{DS}$ is continuously reduced, the transistor 212 originally operating in the saturated region may start operating in the linear region.

Figure 3:
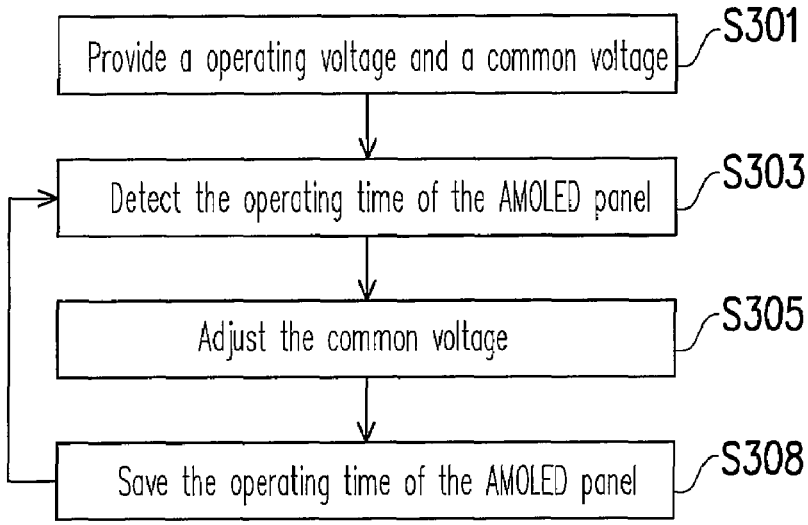
FIG. 3 is a flow diagram of a method for controlling an AMOLED panel according to a preferred embodiment of the present invention.

Therefore, the present invention provides a method for controlling an active matrix organic light emitting diode (AMOLED) panel. FIG. 3 is a flow diagram of a method for controlling an AMOLED panel according to a preferred embodiment of the present invention. As shown in FIG. 3, the power supply 108 provides a operating voltage VDD and a common voltage VSS to the AMOLED panel 102 in step S301 for generating a driving current ID to drive the AMOLED panel 102. The voltage control unit 122 accesses the memory unit 120 to detect the operating time of the AMOLED panel 102 in step S303. According to the result of the detection, the power supply 108 adjusts the common voltage VSS in step S305. Thereafter, in step S308, the memory unit 120 counts and saves the operating time of the AMOLED panel 102 and then repeats the steps from step S303.

One skilled in the art would understand that the transistor in the pixel circuit 1141 can be implemented using an NMOS transistor instead of the PMOS transistor. Similarly, its operation can be deduced from the foregoing method.

Figure 4:
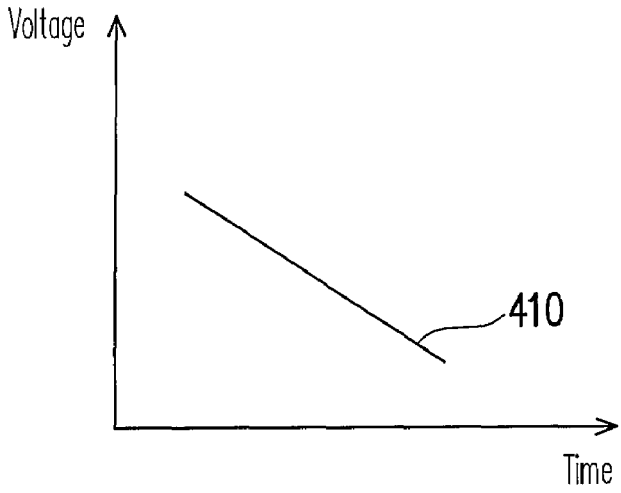
FIG. 4 is a diagram of a common voltage curve according to a preferred embodiment of the present invention.

FIG. 4 is a diagram of a common voltage curve according to a preferred embodiment of the present invention. As shown in FIGS. 2 and 4, an increase in the operating time of the AMOLED panel 102 will lead to an increase in the voltage difference across the organic light emitting diode 220. Hence, the present invention provides a mechanism for lowering the common voltage $V_{SS}$ to compensate for the rise in voltage difference across the organic light emitting diode 220. When the voltage control unit 122 accesses the memory unit 120 to read out the operating time of the AMOLED panel 102, the relationship between the common voltage curve 410 and the operating time of the AMOLED panel 102 can be used to find the current cumulative operating time of the AMOLED panel 102 and a corresponding common voltage $V_{SS}$ value. Therefore, the control circuit 105 can use the power supply 108 to adjust the common voltage $V_{SS}$. In the present invention, the operating voltage $V_{DD}$ is fixed because adjusting the operating voltage $V_{DD}$ may affect the gamma (Γ) value of the panel leading to a change in the brightness of the AMOLED panel 102. However, if the common voltage $V_{SS}$ is adjusted, no such problem will occur. In other words, the present invention fixes the operating voltage $V_{DD}$ and only adjusts the common voltage $V_{SS}$.

Figure 5:
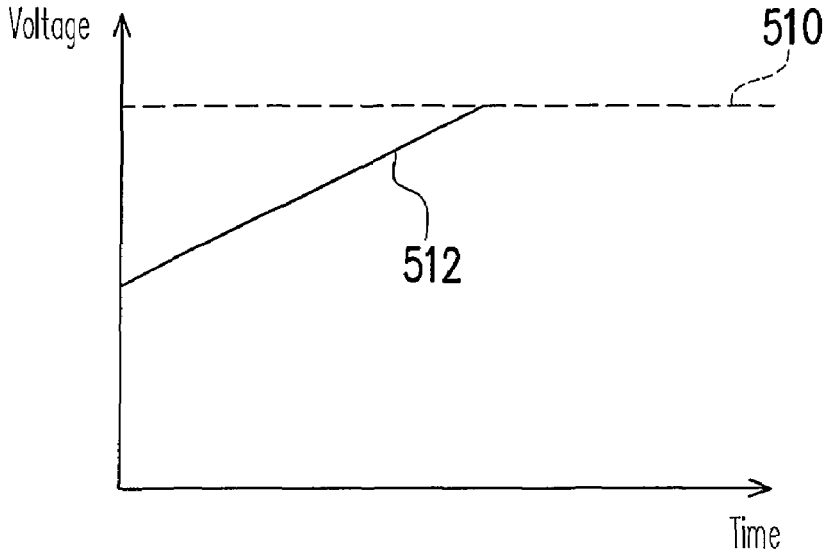
FIG. 5 is a diagram of a curve showing the relationship between the voltage difference between the operating voltage and the common voltage and the operating time of the AMOLED panel.

FIG. 5 is a diagram of a curve showing the relationship between the voltage difference between the operating voltage $V_{DD}$ and the common voltage $V_{SS}$ and the operating time of the AMOLED panel 102. As shown in FIG. 5, when the common voltage $V_{SS}$ is maintained at a constant value, the voltage difference between the operating voltage $V_{DD}$ and the common voltage $V_{SS}$ will remain unchanged by operating time of the AMOLED panel 102. Hence, the relationship between the voltage difference between the operating voltage $V_{DD}$ and the common voltage $V_{SS}$ and the operating time of the AMOLED panel 102 is a straight line 510. In addition, the present invention provides an AMOLED panel 102 with an adjustable common voltage $V_{SS}$. When the AMOLED panel 102 is turned on, only the initial value of the common voltage $V_{SS}$ has to be adjusted to the saturation region of the transistor 212. Then, as the operating time of the AMOLED panel 102 is increased, the common voltage $V_{SS}$ is gradually lowered according to the common voltage curve 410. Therefore, the voltage difference between the operating voltage $V_{DD}$ and the common voltage $V_{SS}$ and the operating time of the AMOLED panel 102 is a slope line 512. In addition, the area enclosed by the straight line 510, the slope line 512 and the voltage axis can be regarded as the energy saved by the AMOLED panel 102.

Figure 6:
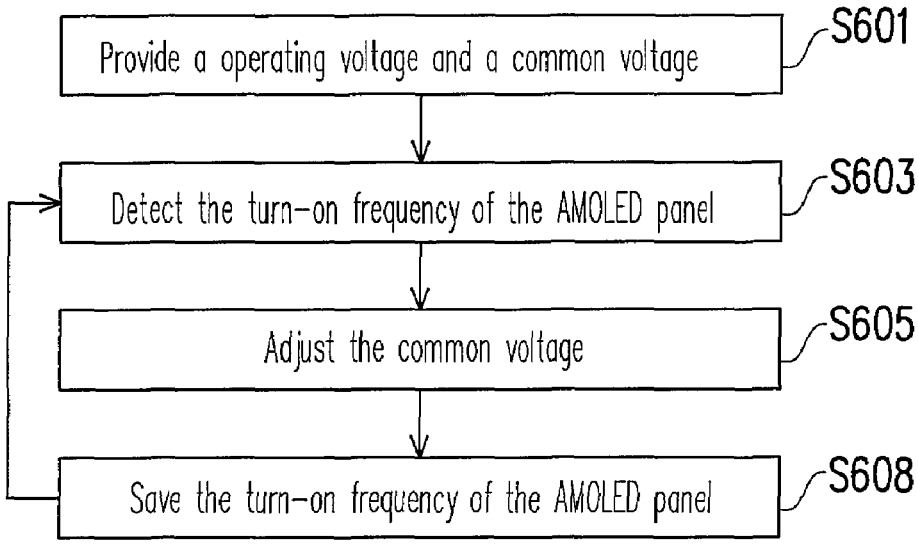
FIG. 6 is a flow diagram of a method for controlling an AMOLED panel according to another preferred embodiment of the present invention.

FIG. 6 is a flow diagram of a method for controlling an AMOLED panel according to another preferred embodiment of the present invention. As shown in FIG. 6, another possible method of operation in the present invention is to use the memory unit 120 to count the turn-on frequency of the AMOLED panel 102 and save the value. First, the power supply 108 provides an operating voltage $V_{DD}$ and a common voltage $V_{SS}$ to the AMOLED panel 102 for generating a driving current ID driving the AMOLED panel 102 in step S601. Then, the voltage control unit 122 accesses the memory unit 120 to detect the turn-on frequency of the AMOLED panel 102 in step S603. Thereafter, according to the result of the detection, the power supply 108 adjusts the common voltage $V_{SS}$ in step S605. Next, in step S608, the memory unit 120 counts the turn-on frequency of the AMOLED panel 102 and saves the value, and then repeats the steps from step S603.

In summary, the present invention provides a control circuit for use in an AMOLED panel, which comprises a memory unit and a voltage control unit. The memory unit is used for counting and saving the operating time or the turn-on frequency of the AMOLED panel. Then, the voltage control unit lowers the common voltage according to the operating time or the turn-on frequency of the AMOLED panel. Consequently, the present invention is able to resolve the problem of an increase in the voltage difference across the terminals of an organic light emitting diode as a result of cumulative usage and provides a stable driving current for the organic light emitting diode and an AMOLED panel with a more stable picture quality.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A control circuit for use in an active matrix organic light emitting diode (AMOLED) panel having a common voltage and an operating voltage, and an OLED being coupled between the common voltage and the operating voltage, the control circuit comprising:

a memory unit for counting and saving an operating time or a turn-on frequency when the AMOLED panel is turned on; and a voltage control unit, electrically coupled to the memory unit, for adjusting the common voltage according to the turn-on frequency or the operating time so as to change a voltage difference between the common voltage and the operating voltage.

2. The control circuit of claim 1, wherein the voltage control unit lowers the common voltage according to an increase in the operating time of the AMOLED panel.

3. The control circuit of claim 1, wherein the voltage control unit lowers the common voltage according to the turn-on frequency of the AMOLED panel.

4. A flat panel display, comprising:

an active matrix organic light emitting diode (AMOLED) panel having a plurality of pixel units;

a timing controller for driving the AMOLED panel;

a power supply for providing an operating voltage and a common voltage to the AMOLED panel; and a control circuit, electrically coupled to the timing controller, for detecting a operating time or a turn-on frequency of the AMOLED panel and controlling the power supply according to the operating time or the turn-on frequency to adjust the common voltage so that a voltage difference between the operating voltage and the common voltage is changed.

5. The flat panel display of claim 4, wherein the control circuit controls a power supply to lower the common voltage according to an increase in the operating time of the AMOLED panel.

6. The flat panel display of claim 4, wherein the control circuit controls the power supply to lower the common voltage according to an increased in the turn-on frequency.

7. The flat panel display of claim 6, further comprising:

a scan driving circuit for generating a scan signal to the AMOLED panel according to the timing controller; and a data driving circuit for generating a data voltage signal to the AMOLED panel according to the timing controller for turning on the pixel units.

8. The flat panel display of claim 7, wherein each pixel unit comprises:

a first transistor having a first terminal for receiving the data voltage signal, and a controlling terminal for receiving the scan signal;

a second transistor having a first terminal coupled to the operating voltage, and a controlling terminal coupled to a second terminal of the first transistor; and an organic light emitting diode having an anode coupled to a second terminal of the second transistor and a cathode coupled to the common voltage.

9. The flat panel display of claim 4, wherein the control circuit comprises:

a memory unit for counting and saving the turn-on frequency or the operating time; and a voltage control unit, electrically coupled to the memory unit, for adjusting the common voltage according to the turn-on frequency or the operating time.

10. A method for controlling an active matrix organic light emitting diode (AMOLED) panel, comprising:

generating an operating voltage and a common voltage to the AMOLED panel;

detecting an operating time or a turn-on frequency of the AMOLED panel; and adjusting the common voltage according to the operating time or the turn-on frequency so that a voltage difference between the operating voltage and the common voltage is changed.

11. The method of claim 10, further comprising counting and saving the operating time.

12. The method of claim 10, further comprising counting and saving the turn-on frequency.

* * * * *